United States Patent [19]

Popma et al.

[11] Patent Number: 4,475,032

[45] Date of Patent: Oct. 2, 1984

[54] PLASMA SPRAYING OF CONVERSION SCREENS

[75] Inventors: Theo J. A. Popma; Gerhardus A. Te Raa; Adrianus T. Vink, all of Eindhoven, Netherlands

[73] Assignee: U.S. Philips Corporation, New York, N.Y.

[21] Appl. No.: 386,143

[22] Filed: Jun. 7, 1982

[30] Foreign Application Priority Data

Jun. 12, 1981 [NL] Netherlands ..... 8102839

[51] Int. Cl.[3] ..... H01J 31/50

[52] U.S. Cl. ..... 250/213 VT; 313/527; 427/34; 427/423; 427/64

[58] Field of Search ..... 427/34; 250/213 VT; 313/527, 528

[56] References Cited

U.S. PATENT DOCUMENTS

| | | | |
|---|---|---|---|
| 3,279,942 | 10/1966 | Granitsas et al. | 427/163 |
| 3,291,706 | 12/1966 | Gebel | 427/163 |
| 3,776,754 | 12/1973 | Levinos | 427/68 |
| 3,833,399 | 9/1974 | Martyn et al. | 427/67 |
| 3,887,724 | 6/1975 | Diakides | 427/163 |
| 4,140,900 | 2/1979 | Wang | 250/213 VT |
| 4,169,239 | 9/1979 | Ehata et al. | 250/213 VT |
| 4,220,890 | 9/1980 | Beekmans | 250/213 VT |
| 4,225,785 | 9/1982 | Ducos et al. | 427/34 |
| 4,327,120 | 4/1982 | Siemers et al. | 427/34 |
| 4,327,155 | 4/1982 | Hanneman | 427/34 |

*Primary Examiner*—John H. Newsome
*Attorney, Agent, or Firm*—Norman N. Spain

[57] ABSTRACT

A conversion screen such as is used for X-ray image intensifier screens, X-ray image intensifier tubes, cathode-ray tubes, image pick-up tubes, X-ray electrography, fluorescent lamps and the like is formed by the deposition of a layer of conversion material on a carrier (19) via a melting space (7) which is preferably heated by means of a plasma arc. This method of deposition offers very robust screens with a high density and also allows the filling of recesses in a carrier with conversion material, so that structured conversion screens can be formed.

4 Claims, 4 Drawing Figures

PLASMA SPRAYING OF CONVERSION SCREENS

The invention relates to a method of manufacturing conversion screens in which a conversion material is deposited on a carrier, to conversion screens manufactured by means of this method and to products comprising such a screen.

A conversion screen usually comprises a carrier on which or in which there is provided a radiation-conversion material. The carrier is adapted to the nature of the screen; for example, it will have a low absorption for radiation to be detected when employed in an entrance screen or an intensifier screen, it will be suitably transparent for the luminescent light developed in the conversion layer when employed in an exit screen, and it will exhibit an adapted electrical conductivity in the case of conversion screens in which a charge pattern is built up by incident radiation, for example, in photoconductive screens. The choice of the carrier is thus determined to a high degree by the nature and the energy of the radiation to be measured, by the nature of the conversion product to be formed in the conversion layer, and by the method of detection or reading of the conversion product.

In screens of this kind the radiation absorption of the conversion layer is preferably comparatively high, because a large part of the information-carrying radiation is then absorbed so that it can contribute to the signal or image to be detected. Factors that are important for a high absorption are inter alia: the absorption coefficient of the material for the radiation to be converted for which the atomic number of the material is usually decisive, and the thickness of the layer of conversion material. The first variable limits the choice of the material to be used, and the second variable is determined to a substantial degree by the density with which the conversion layer of material can be provided, because an increase of the geometrical thickness of the layer as such will always lead to a loss of resolution of the screen. The thickness of the conversion layer, therefore, is a compromise between maximum absorption and optimum resolution. A high absorption is also important because it limits the radiation dose for the patient in the case of, for example, X-ray detection screens in medical diagnostic apparatus. However, in a thick layer a loss of resolution will occur due to lateral scattering of incident radiation before absorption also as well by scattering of the radiation or charge carriers generated in the layer. Therefore, a layer of conversion material which has a high absorption coefficient for conversion and a high density is desirable, so that the geometrical layer thickness may remain small. On the basis of these considerations attempts have been made to manufacture, for example, luminescent screens of quasi-monocrystals, for example, as described in U.S. Pat. No. 3,475,411. However, this method is not suitable for large scale use.

A more practical condition to be satisfied during the production of conversion screens is that the adherence between the carrier and the conversion layer must be very good. This is notably the case when the screens have to be subjected to a further treatment. The conversion layer is then liable to come loose from the carrier (as indicated in U.S. Pat. No. 2,983,816). Moreover, an additional layer must often be provided on the conversion layer, for example, a photocathode on an entrance luminescent screen of an X-ray image intensifier tube. During such an operation no mechanical problems with the luminescent layer should occur. A further treatment frequently used for such luminescent screens is the formation of a crackled structure and the filling of crackles thus formed with a light reflective or absorbing material as described in U.S. Pat. No. 3,885,763. Good adherence to the carrier is also important for the dissipation of heat which is developed in the conversion layer during irradiation and which limits, for example, the permissible radiation load in the case of exit screens of image intensifier tubes and display screens of cathode ray tubes.

Two methods of depositing, for example, luminescent layers are customarily used: the settling of a suspension of luminescent material which usually requires a binder for the adherence of the luminescent material to the carrier and for mutual adherence. Notably because of the presence of the binder, the density of these luminescent layers is comparatively low, for example, at the most approximately 50% of the theoretical bulk density of the luminescent material. Therefore, in order to obtain a reasonable radiation absorption, these layers must be comparatively thick, for example, 500 μm for X-ray intensifier screens and entrance screens of X-ray image intensifier tubes.

A second method is the vapour deposition of the luminescent material as described in U.S. Pat. No. 3,825,763. This method offers luminescent layers having a density which approaches the theoretical bulk density and which certainly can amount to 95% thereof. The adherence to the carrier, moreover, is sufficient to allow the described further treatments. Vapour deposition of this type of layers with a layer thickness of up to, for example, approximately 250 μm for entrance screens of X-ray image intensifier tubes is a comparatively expensive process which is critical as regards the atmosphere in which vapour deposition takes place. Moreover, many conversion materials are not suitable for vapour deposition, for example, because of decomposition.

It is an object of the invention to provide a method of manufacturing a conversion screen so that the screens can be manufactured rapidly and inexpensively up to a comparatively large layer thickness without loss of quality and with a high degree of freedom as regards the choice of the carrier as well as of the conversion material.

To this end, the method of manufacturing conversion screens of this kind set forth in accordance with the invention is characterized in that conversion material powder entrained in a gas stream is projected through a melting space in which it is melted and is impacted upon a carrier which is at a temperature below the melting temperature of the conversion material.

High quality layers of different thickness can be deposited in a comparatively short period of time by means of the method in accordance with the invention when the size of the powder particles, the flow rate, the temperature and the volume of the melting space are mutually optimized. The adherence to the carrier and the mutual adherence in the layer itself is so high that the layer may be subjected to further mechanical operations such as, grinding, polishing or to etching. Thanks to the suitable mutual adherence, it is also possible to remove the carrier so that self-supporting layers of converting material can be formed.

For the melting process use is preferably made of a plasma discharge in which a temperature of, for example, 10,000° C. can be reached without local development of combustion products which could contaminate the substance to be deposited. Thanks to the high temperature, the grains of material melt very rapidly and inter alia thanks to the high flow rate, they are deposited on the carrier within a very short period of time. Excessive oxidation or decomposition of the substances is thus prevented, so that already activated luminescent materials can also be simply used. This not only eliminates one operation, but also prevents possible damage to or contamination of the layer or the carrier during the additional treatment. By deposition of the material on or in a carrier having a structured surface, for example, as described in GB No. 1,380,186, screens can be obtained which have a crackled structure in the converting layer, so that lateral scattering of radiation or charge carriers is limited. In a preferred embodiment, the carrier for a luminescent screen consists of a fibre-optical plate in which the cores of the glass fibres have been partly removed by etching on the side of the luminescent layer.

In comparison with the known deposition methods, the method in accordance with the invention also suitably fills recesses in the carrier, even if they have a comparatively small transverse dimension.

Radiation conversion screens manufactured by means of the method in accordance with the invention can be used in many products, for example, as X-ray intensifier screens such as are used in X-ray diagnostic apparatus. Therein, the screens serve to convert an image-carrying X-ray beam, with a minimum loss of image quality, into radiation for which a film foil arranged behind the screen is specifically sensitive. In image intensifier tubes, the screens may be used as entrance screen as well as exit screen, specific advantages over known screens being achieved for both functions as has already been stated. In X-ray detectors, for example, as described in U.S. Pat. No. 4,179,100 use can be advantageously made of screens in accordance with the invention, if necessary, with a structured carrier, so that a more pronounced series of independent detector elements can be formed.

Screens in accordance with the invention can be used in cathode-ray tubes with the advantage for mass production that use is made of a very fast and stable process in which less problems occur as regards loose phosphor particles in the tube and in which the metal backing customarily used in said tubes can be deposited directly on the dense phosphor layer, possibly with one and the same method. For cathode-ray tubes for special applications such as electron microscopes and oscilloscope tubes and for exit screens of image intensifier tubes, the dense packing with the reduced layer thickness and the improved dissipation of heat is attractive, because a higher local load is permissible. Thanks to the latter property, these screens also offer advantages for measuring instruments for the detection of elementary particles, such as mass spectrography apparatus in which the self-supporting property can be used to increase the sensitivity and in which the robust screens now allow the use of exchangeable screens. Radiation conversion layers having photoconductive properties can be used, for example, for X-ray detection, in the form of selenium screens on which an image formed by an incident image-carrying X-ray beam can be converted into a written image, via a charge pattern in an electrographic process, or in image pick-up tubes in which an electric potential pattern produced by an incident image-carrying radiation beam is converted into a video signal, for example, for display on a monitor.

Some preferred embodiments in accordance with the invention will be described in detail hereinafter with reference to the drawing. Therein:

FIG. 1 diagrammatically shows a device for performing the method in accordance with the invention with the aid of a plasma arc;

Figure 1:
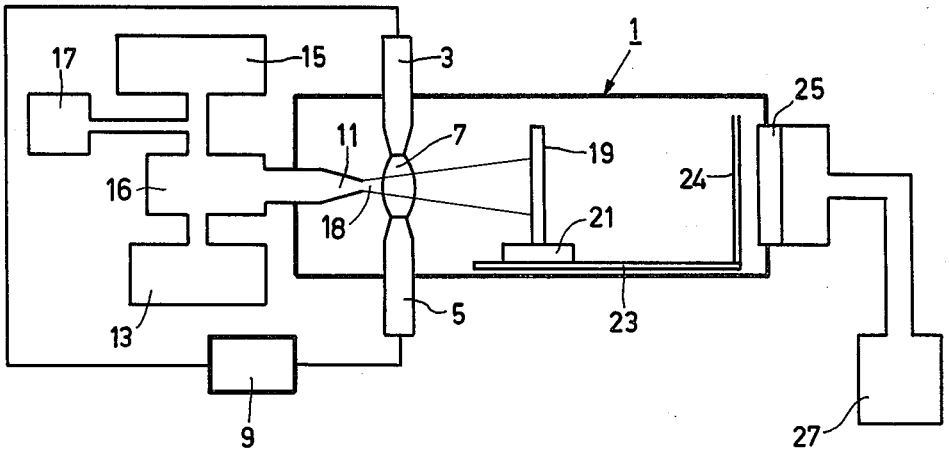

FIG. 1 shows a device for the manufacture of conversion screens in accordance with the invention by plasma spraying. For this purpose, the device comprises, accommodated in a housing 1, a first electrode 3 and a second electrode 5 for generating a plasma discharge 7, for which purpose a voltage source 9 is connected across the two electrodes. Powdered conversion material is supplied from a container 13 together with a gas stream from a gas pressure vessel 15 into a mixture room 16. A flow 18 of gas and powdered conversion material is projected via a nozzle 11 through the plasma discharge arc 7. The container 13 can be provided with means for producing powder from rough conversion material. Preferably use is made of a powder having grain size which is between comparatively narrow limits. If a very fine-grained powder is desirable, it may be advantageous to add a flow powder in order to avoid clottging together of the grains under the influence of van der Waals' forces; for this purpose there is provided a vessel 17. For the flow powder use can be made of, for example, $Al_2O_3$ or $SiO_2$. The clotting together can also be prevented by using electrically charged grains. The mixture stream 18 of powder and glass is sprayed in the direction of the plasma with a comparatively high speed, for example, under a pressure of 100 kPa. A carrier 19 is arranged behind the plasma arc at a distance which is preferably adjustable; the carrier 19 is diagrammatically shown as being mounted on a slide 21 which is displaceable on a rail 23. At the end of the rail which is remote from the plasma arc there is provided a shield 24 and behind the shield there is arranged an exhaust device comprising a filter 25 and a pump 27. The device shown is of the type comprising a closed chamber, for example, in order to enable operation with a reduced pressure, and is described in detail in U.S. Pat. No. 3,839,618. Depending on the substances to be deposited and the requirements imposed on the layer to be formed, use can alternatively be made of an open arrangement, or an arrangement comprising locks for the feeding of the carrier on the one side and for the discharging of the screens on the other side. For larger screens, the slide 21 may comprise a mechanism for displacement of the carrier in a direction transversely of the flow direction of the material beam. In order to achieve a homogeneous layer or a layer having, for example, a radially varying thickness, it may be advantageous to mount the carrier to be rotatable about an axis which is coincident with the principal direction of the material beam. Further, kinematic reversal of the relative movement of material beam and carrier is also possible, so that a moving spraying device can be used.

During the passage through the plasma discharge, the material grains carried along by the material flow are heated, so that they leave the arc as liquid droplets of material which are deposited on the carrier. In order to obtain a suitably homogeneous layer, use is preferably made of a powder comprising grains having a comparatively uniform size, thinner layers usually requiring a smaller grain size. The structure of the deposited conversion layer can be further influenced by way of the flow rate of the material flow, the temperature of the discharge arc, the distance between discharge arc and carrier, the temperature of the carrier during the deposition of the material, and the atmosphere and the pressure in the working space which is closed or not. Obviously, the various parameters are not mutually independent. For example, the degree of heating of the grains is determined not only by the temperature of the layer, but also by the duration of the stay of the grains in the arc, so by the material flow rate and the dimension of the arc measured in the direction of the material flow 18. For the necessary heating energy per grain of material, of course, the grain size is also important.

The temperature of the carrier may usually be the same as the ambient temperature, but the deposited, very hot material heats the carrier. Therefore, it may be desirable to cool the carrier during the process or to mount it on a heat sink which prevents excessive heating. For specific carrier material as for instant Al it is advisable to heat-up the carrier before the conversion material is deposited thereon. For this purpose the carrier can be mounted on a heater.

It is known that this method of deposition of metal layers results in layers which adhere firmly and have a dense packing. Therefore, the method is widely used for the deposition of protective corrosion-resistant layers which usually consist of an elementary material, such as metals.

Surprisingly, it has been found by means of this method that compounds can also be deposited which do not decompose during the heating and the transport of the heated compounds to the corner. It is even more surprising that a luminescent layer thus formed exhibits favourable luminescent properties. It is a very attractive additional circumstance that the luminescent layers thus formed do not require further thermal treatment in order to enhance the luminescent properties. As a result, the choice for the carrier is much wider; moreover screens can now be formed for applications where external circumstances necessitate the use of special carriers, for example, exit screens for image intensifier tubes which must have given light optical properties. Good results have been obtained with conversion material on an aluminum carrier having good optical reflecting properties which of course is attractive for a high light output efficiency.

Figure 2:
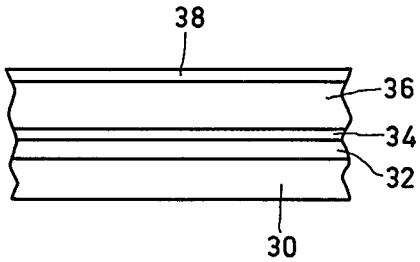
FIG. 2 is a sectional view of an X-ray intensifier screen in accordance with the invention.

The choice of conversion material is also very broad. Favourable results have been obtained for luminescent screens with $CaWO_4$ which is a material often used in X-ray image intensifier screens where it is customarily deposited from a colloidal solution together with a binder; consequently, known layers have a luminescent material density of at the most approximately 50% of the theoretical bulk density. FIG. 2 diagrammatically shows such a screen, comprising a carrier 30, an antistatic layer 32, a reflective layer 34, a fluorescent layer 36 and a shielding layer 38. When the same luminescent material is used as in known intensifier screens, i.e. $CaWO_4$, the denser packing enables the layer thickness thereof to be reduced to approximately one half while the desired minimum absorption is maintained. On the other hand, a layer of the same thickness will exhibit a substantially higher absorption. Both effects can be used to reduce the X-ray dose sustained by a patient; the first approach places more emphasis on a higher image quality. For this application, a luminescent layer in accordance with the invention has a thickness of, for example, approximately 200 μm in comparison with, for example, 500 μm for customary layers. Intensifier screens of this kind are widely used in X-ray diagnostic apparatus comprising a Bucky grid, such as tomography apparatus and fluoroscopy apparatus. In addition to the fact that X-ray intensifier screens in accordance with the invention have a higher resolution, the manufacture thereof by means of the method in accordance with the invention is substantially cheaper and the freedom as regards the choice of materials of the carrier and the antistatic layer, if any, is greater. The resolution of screens in accordance with the invention can be further increased by using a crackled structure as described in U.S. Pat. No. 3,961,182 in order to reduce transverse scattering. It is because of the particularly good adherence of the luminescent material to the carrier that this method can be optimized. Use can be made of a carrier in which there is provided a structure which is determinative of the crackle structure. Usually it will not be necessary to deposit the layer in several sublayers in order to obtain a suitable crackle structure. Besides $CaWO_4$, use can be made of $Y_2O_3$(Eu), ZnS and materials derived therefrom or CsI(Na) as the luminescent material for these screens. The hygroscopic nature of CsI(Na) then imposes fewer problems thanks to the dense structure of the layer.

Figure 3:
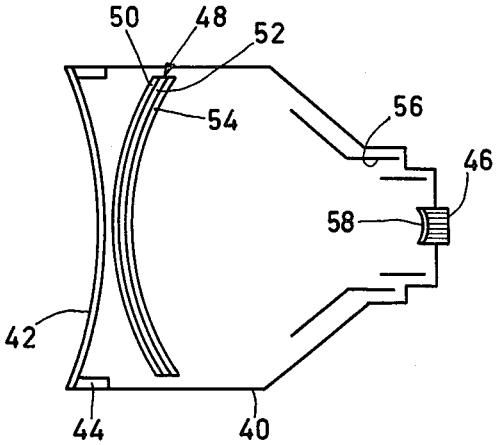
FIG. 3 shows an X-ray image intensifer tube in accordance with the invention.

A second application of screens in accordance with the invention is in image intensifier tubes, notably X-ray intensifier tubes. An X-ray image intensifier tube as shown in FIG. 3 comprises a metal housing 40 with an entrance window 42 which consists of a titanium window having a thickness of, for example, 250 μm which is connected to a jacket portion of the housing via a supporting ring 44, and with an exit window 46 which is in this case formed by a planoconcave fibre-optical plate. The housing accommodates a luminescent screen 48 with a carrier 50, a luminescent layer 52 and a photocathode 54, and an electron optical system 56 for the formation of an image of electrons to be emitted by the photocathode on a luminescent screen 58 which is in this case arranged directly on a concave side of the fibre-optical window 46 and which acts as an exit screen. The luminescent layer 52 of such an X-ray intensifier tube is described in detail in U.S. Pat. No. 4,213,055; it consists of, for example, CsI(Tl) vapour deposited in vacuum and has a high resolution, notably because of the crackled structure formed therein. In view of the thermal aftertreatment necessary in the case of vapour-deposited CsI, this method cannot be simply used for the exit screen of the tube. The choice of the luminescent material to be used for this purpose is also limited, because the high speed of the incident electrons, for example, up to 30 kV, is liable to cause burning phenomena in the screen.

Figure 4:
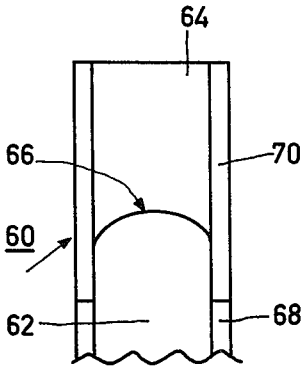
FIG. 4 shows a glass fibre of a screen in accordance with the invention partly filled with luminescent material.

These circumstances often necessitate the use of ZnS as the luminescent material for the exit screen, which is deposited by settling from a suspension. When an exit window manufactured by a method according to the invention is used in such a tube utilizing ZnS as the luminescent material, a substantial improvement is obtained as regards resolution or sensitivity due to the denser stacking of material, as well as regards resistance against burning, because the heat conduction is higher due to the denser packing. Because CsI screens require no thermal after-treatment, as has already been stated, for example, CsI(Na) can also be used for the exit screen in accordance with the invention, so that the absorption and hence the efficiency and the resolution of the screen are even higher. The layer of luminescent material can again be provided with a crackled structure so that the resolution is even further enhanced. When the cracks are filled with a suitable substance, it is ensured that the improvement of thermal conduction in the plane of the layer is retained. A particularly attractive embodiment utilizes the fibre structure of the fibre-optical exit window as a basis for the crackled structure. For this purpose, the cores of the fibres are removed up to a depth of, for example, some tens of μm on the side of the fibre optical plate on which the luminescent layer is to be provided, the recesses thus formed being filled with luminescent material. The coating material can be made to be highly absorbent for the luminescent light at the area of the recesses by red staining, see U.S. Pat. No. 3,582,297, so that the scattering of light in the layer can be substantially reduced. Thanks to the extremely good adherence of the luminescent material, if desirable, material deposited on the coating ends of the fibres can be ground away, so that luminescent material is present only in the recesses in the fibres and a crackled structure need not be provided. The transmission of light between the luminescent material and an end face of the fibre core is increased by imparting a concave shape to the end face as appears from FIG. 4.

A part of a core 62 of an optical fibre 60 shown therein has been removed by etching in order to form a space 64. As a result of an adaptation of the radial variation of the glass composition and/or an adaptation of an etching process, an end face 66 of the core has a convex shape and acts as a lens for the luminescent light incident thereon. The refractive index ratio of coating glass and core glass as well as the refractive index ratio of core glass and luminescent material has an effect on the nature of the curvature thereof. Parts 70 of a coating 68 of the fibre have been made to be light-absorbing or light-reflective, for example, by means of a diffusion process.

Even though, as has already been stated, the entrance screen of the X-ray image intensifier tubes described in U.S. Pat. No. 3,961,182 and U.S. Pat. No. 4,213,055 does not necessitate a modification in view of image quality and sensitivity, the invention is still useful in this respect, because the method offers cheaper screens, notably because the process is much faster and less susceptible to atmospheric conditions. Moreover, the improved adherence offers more freedom as regards the formation of a crackled structure, so that this operation can be optimized without the risk of additional rejects. As an extreme consequence thereof, use can be made of a filled honeycomb structure which may then comprise, for example, recesses having a transverse dimension of approximately 50 μm and a depth of 250 μm. The embodiments described with reference to an X-ray image intensifier tube also hold good to the same extent for other image intensifier tubes comprising a conversion layer, such as light intensifier tubes, infrared tubes and the like. Thus far, embodiments have been described in which radiation such as X-rays or electron radiation is converted in the conversion layer into (visible) light; these layers are usually referred to as luminescent layers or phosphor layers. Conversion layers for the conversion of electron radiation into light are often used, for example, for television display tubes, oscilloscope tubes etc.

Thus far no restrictions have been found which could preclude the formation of screens in accordance with the invention for this purpose. Notably for apparatus in which, for example, high-energy electromagnetic radiation, electrons, ions or other elementary particles are detected, the dense packing and good adherence of the layer are particularly attractive. Thus, there is a smaller risk of burning of the layer and the layer is less susceptible to conta-mination. Any contamination occurring can also be removed from the layer without risk.

A further type of conversion layers consists of layers which convert the incident radiation, for example, X-rays, electron radiation or light, into a potential distribution on a surface of the conversion layer. An example thereof is formed by selenium screens which are used in an electrographic process in order to form images by means of X-rays. A potential image formed in such a layer by radiation can be converted into an electric signal, for example, a video signal for display on a monitor by scanning, for example, by an electron beam, in a pick-up tube or by a probe or a matrix of probes. For such applications the screens in accordance with the invention again increase the resolution and the sensitivity due to the higher density, and the radiation load thanks to the improved thermal conductivity. Moreover, the mass production of such screens again offers a substantial cost reduction. In addition to the reduction of rejects during the production, this cost factor is also important, for fluorescent layers such as are used in lamps in which the radiation produced by the primary radiation source is situated in a part of the spectrum which is less suitable for illumination. At least a part of the envelope of such lamps is provided with a fluorescent layer in accordance with the invention in order to convert the radiation, for example, ultraviolet radiation, into radiation which is situated within a spectral range which is more suitable for illumination purposes.

Although the method is described employing to a plasma arc as the melting space, good results can also be obtained by a flame arc, such as provided with an acetylene flame device. With this method a conversion layer of $CaWO_4$ on an optically reflecting carrier of aluminum have been obtained without problems with the connection of the conversion material to the carrier. A device provided with such a screen, of course, has an improved light efficiency due to the good light reflection from the carrier.

What is claimed is:

1. An X-ray image intensifier tube having an entrance screen comprising a first phosphor layer deposited upon a first carrier, an exit screen comprising a second phosphor layer deposited upon a second carrier and sides connecting said two screens, characterized in that said phosphor layers are dense homogeneous layers consisting of phosphor material provided on said carriers by forming a dispersion of a self-adhering powder of said phosphor material in a gas stream, passing said dispersion through a heated zone capable of melting said powder to thereby melt said powder and then causing said molten powder to impact upon a carrier maintained at a temperature below the melting point of said powder.

2. The X-ray image intensifier tube of claim 1 wherein the carrier of the exit screen is an optical fiber window.

3. An X-ray image intensifier tube of claim 1 wherein the second phosphor layer is a cesium iodide layer.

4. The X-ray image intensifier tube of claim 3 wherein the carrier of the exit screen is an optical fiber window.

* * * * *